United States Patent [19]

Dessau

[11] 4,076,505

[45] Feb. 28, 1978

[54] COAL DESULFURIZATION PROCESS

[75] Inventor: Ralph M. Dessau, Edison, N.J.

[73] Assignee: Mobil Oil Corporation, New York, N.Y.

[21] Appl. No.: 743,739

[22] Filed: Nov. 22, 1976

[51] Int. Cl.[2] ..... C10L 9/10; C10L 9/00; C10B 57/00

[52] U.S. Cl. ..... 44/1 R; 44/6; 201/17

[58] Field of Search ..... 201/17; 44/1 R, 6

[56] References Cited

U.S. PATENT DOCUMENTS

| | | | |
|---|---|---|---|
| 2,346,151 | 4/1944 | Burk et al. | 44/1 R |
| 2,448,605 | 9/1948 | Kleinicke | 44/6 X |
| 3,252,769 | 5/1966 | Nagelvoort | 44/1 R |
| 3,988,120 | 10/1976 | Chia | 44/1 R |

*Primary Examiner*—Carl F. Dees

*Attorney, Agent, or Firm*—Charles A. Huggett; Carl D. Farnsworth

[57] ABSTRACT

This invention provides an improved process for reducing the pyritic sulfur content of coal, which process involves (1) contacting finely divided coal under sink-float separation conditions with a heavy organic parting medium which contains dissolved therein a dispersant quantity of a novel type of soluble sulfanilate ionic surfactant; and (2) separating a coal float phase from the liquid medium system, and recovering coal which has a lower sulfur and ash content than the untreated raw coal.

6 Claims, No Drawings

COAL DESULFURIZATION PROCESS

BACKGROUND OF THE INVENTION

Coal is primarily employed for conversion into electrical and thermal energy. A major disadvantage of coal which is mined in the United States is the high sulfur content, i.e., a sulfur content which ranges up to about 5 weight percent.

The annual rate of coal production in the United States has reached about 600 million metric tons on the basis of 1975 estimates. Approximately three-fourths of the coal production is burned directly for the generation of electricity and steam power, for comfort heating, for metallurgical processes and for kiln firing of ceramics.

A one million kilowatt plant burns about 8500 tons per day of coal. This corresponds to a stack emission of sulfur oxides equivalent to about 1000 tons of sulfuric acid per day, for combustion of coal fuel having a weight content of 3.5 percent sulfur.

The sulfur in coal occurs in three forms: (1) pyritic sulfur in the form of pyrite or marcasite, (2) organic sulfur, and (3) sulfate sulfur. The primary sulfur contaminants are of the first two forms.

Increased exploitation of coal as fuel is restricted because of the pollution problems inherent in plant scale combustion of coal for its energy value.

Continuous research and development effort is in progress for the study of coal pollution problems and for provision of improved pollution abatement technology.

Conventional systems for desulfurization of stack effluent gases are effective for pollution control, but such systems are too capital-intensive and impractical for general application.

Other developments for control of sulfur emission from coal burning furnaces involve the desulfurization of coal prior to combustion.

The use of manganese oxide to desulfurize coal and coal products has long been known in the art. These prior processes may be characterized as high-temperature volatilization processes. U.S. Pat. No. 28,543 discloses a process for the removal of sulfur after the coking process, wherein a mixture of sodium chloride, manganese peroxide, resin, and water is applied to the red-hot coke, and sulfur is oxidized and released from the coke mass in gaseous form. Other similar processes are disclosed in U.S. Pat. Nos. 90,677; 936,211; 3,348,932; and 3,635,695.

The use of oxidative solubilization processes to remove sulfur from coal is a relatively new concept. Even though the solubilization of pyrites by various oxidizing agents, including nitric acid, hydrogen peroxide, hypochlorite, ferric and cupric ions, has long been known, the application of these reactions to the removal of pyrite from coal is a recent development.

U.S. Pat. No. 3,768,988 describes a process which employs aqueous ferric sulfate or chloride to oxidize pyritic sulfur to coal to elemental sulfur:

$$2Fe^{+3} + F_2S_2/\text{coal} \rightarrow 3Fe^{+2} + 2S/\text{coal}$$

The elemental sulfur thus formed is removed by solvent extraction of the coal or by heat treatment of the coal to volatilize the elemental sulfur.

U.S. Pat. No. 3,824,084 discloses a method for production of low sulfur coal by treatment of high sulfur coal with water and air at elevated temperature and pressure to convert pyritic sulfur to water-soluble ferrous and ferric sulfate.

U.S. Pat. No. 3,909,211 describes a coal desulfurization process which involve heat treatment of the coal in the presence of $NO_2$, wherein sulfur in the coal is selectively oxidized into compounds which are more readily separable from the treated coal.

U.S. Pat. No. 3,909,213 discloses a coal desulfurization process which comprises digesting coal and a Group IA or IIA metal oxide in the presence of a fused metal chloride salt medium capable of dissolving sulfur-containing compounds in the coal. The metal sulfides produced are converted to metal chlorides and hydrogen sulfide by treatment with anhydrous hydrogen chloride.

It is also possible to remove pyritic sulfur from coal by froth flotation as reported in BuMines TPR 51 (1972) publication entitled "Flotation Of Pyrite From Coal". Froth flotation has the disadvantage of poor selective concentration of coal from its sulfur and ash components.

A DuPont gravity concentration minerals separation process is described in U.S. Pat. Nos. 2,150,899; 2,150,917; 2,150,918; 2,150,946; 2,150,947; and 2,151,578. The DuPont process, employing chloroethane parting liquid, was installed on a pilot-plant scale in the Pennsylvania anthracite fields in 1936. The raw feed with the fines screened out was sprayed with a solution of tannic acid or starch to prevent loss of the parting liquid by surface filming. The process was generally applicable for gross sink-and-float separation of ash and refuse from No. 1 buckwheat and larger size coal stock, and for salvaging fuel values from refuse feeds.

Coal desulfurization processes involving chemical means are in general relatively complicated and not economically attractive. As a simple solution to coal combustion pollution problems, coal having an acceptably low sulfur content has been the premium fuel of choice for energy conversion needs. Many pollution control districts prohibit combustion of coal having more than 1.0 percent sulfur content. This has disqualified the use of many United States coals, 90 percent of which average about 2.5 percent by weight of sulfur. There remains a need for improved coal desulfurization technology for converting high sulfur coal into a solid carbonaceous fuel which satisfies increasingly stringent pollution control regulations.

Accordingly, it is a main object of the present invention to provide an efficient and economical process for desulfurizing solid carbonaceous fossil fuels which have a sulfur content above 1.0 weight percent.

It is another object of the present invention to provide a process for reducing the sulfur content of coal without chemical conversion of the sulfur into elemental or other forms of sulfur.

It is another object of this invention to provide a process for separating pyritic sulfur and ash from finely divided coal in a liquid system without floc formation of the fine coal particles.

Other objects and advantages of the present invention shall become apparent from the accompanying description and examples.

DESCRIPTION OF THE INVENTION

One or more objects of the present invention are accomplished by the provision of an improved process for reducing the pyritic sulfur and ash content of coal under sink-float separation conditions which comprises (1) contacting finely comminuted coal with a heavy organic liquid medium having dissolved therein dispersant quantity of ionic surfactant which is a hyrocarbyl-succinimide derivative of an aminoarylsulfonic acid salt; and (2) separating the coal float phase from the heavy organic liquid medium, and recovering coal with a reduced sulfur and ash content.

The term "pyritic sulfur" refers to iron pyrites which are contained in natural coal deposits. Iron pyrites correspond to the formula $FeS_x$, where $x$ is a fractional or whole number from about 0.5 to about 4.

Coal Component

The term "coal" is meant to include solid carbonaceous fossil minerals such as anthracite coal, bituminous coal, sub-bituminous coal, lignite, peat, and the like.

It is an important feature of the present invention process that the treated coal product recovered from the process has both a reduced sulfur content and a reduced ash content.

The sulfur content and ash content of various coals suitable for use in the invention process are as follows:

| | |
|---|---|
| **High Volatile B** | |
| Sulfur | 6.81 |
| Nitrogen | 0.88 |
| Oxygen | 4.97 |
| Carbon | 56.90 |
| Hydrogen | 3.11 |
| Ash | 21.01 |
| **Sub-Bituminous A** | |
| Sulfur | 2.48 |
| Nitrogen | 0.77 |
| Oxygen | 9.16 |
| Carbon | 54.01 |
| Hydrogen | 3.92 |
| Ash | 18.91 |

Ball mills or other types of conventional apparatus may be employed for pulverizing raw coal in the preparation of the finely comminuted feed coal for the process. The crushing and grinding of the coal can be accomplished either in a dry state or in the presence of a liquid such as the heavy organic liquid medium being employed in the practice of the invention process.

The efficiency of pyritic sulfur and ash removal is directly dependent upon the degree to which the raw coal has been pulverized. The efficiency of the pyritic sulfur and ash removal tends to increase as the average size of the coal particles decreases. Under sink-float conditions, it is necessary for iron pyrites and ash to be in the form of discrete particles in order for the mechanism of gravity concentration based on differential specific gravity to be operative. Preferably, the average particle size of the pulverized raw coal being desulfurized and deashed by the invention process is in the range between about 10 and 200 mesh.

Liquid Medium Component

A heavy organic liquid is employed as the parting medium in the invention process for gravity concentration and separation of finely comminuted coal from the sulfur and ash contaminants.

Preferred parting liquid media are halogenated hydrocarbons, and mixtures thereof, which contain 1-2 carbon atms and 2-6 halogen atoms. Illustrative of suitable halogenated hydrocarbons are methylene bromide; methylene chlorobromide; methylene iodide; dibromochloromethane; tribromofluoromethane; bromotrichloromethane; bromoiodomethane; dibromodichloromethane; bromodichloromethane; tetrachloromethane; 1,2-dibromoethane; 1,1,2,2-tetrafluoro-1,2-diiodoethane; 1,1-dibromo-2,2-difluoroethane; 1,2-dibromo-1,1,2-trichloroethane; 1,2-dibromo-1-chloro-2,2-difluoroethane; 2,2-dibromo-1,1,1-trifluoroethane; 2,2-dibromo-1,1,1-trifluoroethane; 1,2-dibromo-1,1-difluoroethane; 1-chloro-1,1,2-trifluoro-2-iodoethane; 1,1-dibromotetrafluoroethane; 1,2-dibromotetrafluoroethane; and the like.

For the purposes of the present invention process, it is required that the heavy organic liquid parting medium have a specific gravity which is intermediate between that of the coal particles and the pyrite and ash particles. The gravity concentration of coal from impurities is effective when the density of the liquid parting medium is greater than that of the coal, and lesser than that of the pyrite and ash constituents of the coal.

Illustrative of comparative specific gravities (20° C) are the following:

tetrabromoethane: 2.96
methylene iodide: 3.26
pentachloroethane: 1.67
coal (average): 1.10
pyrite ($FeS_2$): 4.90
coal ash: 2.50

The particular heavy organic liquid medium employed can have a specific gravity in the range between about 1.1 and 3.3 for effective gravity concentration of pyrite from coal. For purpose of ash concentration and separation from coal, a liquid medium with a specific gravity in the range between about 1.1 and 2.5 is preferred. The specific gravity of the liquid medium can be precisely controlled by custom blending of approximate organic liquids such as methylene bromide/methylene chlorobromide, methylene bromide/perchloroethylene, and the like. A liquid medium of equal proportions of hexane and carbon tetrachloride has a specific gravity of 1.2.

Ionic Surfactant Component

An important aspect of the present invention coal desulfurization process is the provision of a novel ionic surfactant which is dissolved in the heavy organic parting medium in a dispersant quantity. The novel ionic surfactant has an exceptional affinity for the surface area of finely comminuted coal.

The said ionic surfactant is a hydrocarbyl-succinimide derivative of an aminoarylsulfonic acid salt. In a preferred embodiment, the ionic surfactant corresponds to the structural formula:

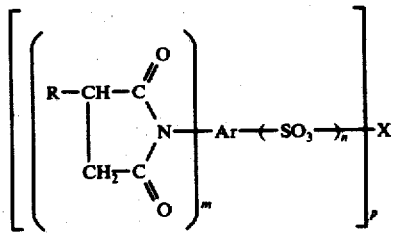

wherein R is an acyclic hydrocarbyl group containing between about 5 and 1000 carbon atoms; Ar is a polyvalent aromatic radical; X is a metal or $HNR'_3$ cation, and R' is hydrogen or a hydrocarbyl substituent; $m$ is an integer having a value of 1 or 2; $n$ is an integer having a value of 1 to 4; and $p$ is an integer having a value of 1 or a value up to the valence of X.

The hydrocarbyl-succinimide derivatives of aminoarylsulfonic acid salts described above can be prepared by reacting a hydrocarbyl-succinic acid anhydride or ester with a sulfanilate type salt, wherein the two reactants have structures corresponding in combination to the desired hydrocarbyl-succinimide derivative of aminoarylsulfonic acid salt.

The synthesis of hydrocarbyl-succinic compounds is described in U.S. Pat. Nos. 2,568,876 and 3,219,666. The synthesis of ionic surfactants corresponding to the hydrocarbyl-succinimide derivatives of aminoarylsulfonic acid salts described above is more fully disclosed in copending patent application Ser. No. 391,178, filed Aug. 24, 1973, and incorporated herein by reference.

In the structural formula represented hereinabove, R is a hydrocarbyl group such as straight chain or branched chain alkyl or alkenyl substituent, e.g., pentyl, hexenyl, isooctyl, decyl, tetradecyl, tetradecenyl, eicosyl, and the like. R can also be an oligomer of a polymerizable olefin such as propylene, butylene, isobutylene, octene, decene, and the like.

In the said structural formula, Ar is an aromatic radical derivative of compounds such as benzene, nitrobenzene, phenol, toluene, xylene, diphenyl, naphthalene, naphthol, anthracene, phenanthrene, fluorene, acenaphthylene, and the like.

In the said structural formula, X is a cation such as ammonium, methylammonium, trimethylammonium, tributylammonium, tetraethylenepentammonium, hexamethylenediammonium, lithium, sodium, potassium, magnesium, calcium, zinc, barium, strontium, and the like.

The ionic surfactants corresponding to the structural formula hereinabove can range in molecular weight from simple monomolecular structures to complicated high molecular weight gel structures. The ionic surfactants can contain one or a multiple of each of the hydrocarbyl-succinamido, aromatic and sulfonic moieties in the ionic surfactant molecular structures.

It is also contemplated within the scope of the present invention process to employ an ionic surfactant which corresponds to the structural formula represented above in which the hydrocarbyl-succinimide moiety is in the form of an acyclic amido/carboxylate hydrolysis product:

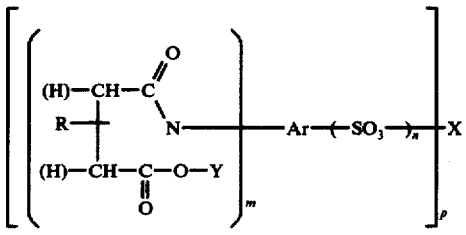

wherein R, Ar, X, $m$, $n$ and $p$ are as previously defined, and Y is hydrogen or metal or other form of cation.

Process Embodiments

In a batch-type float-sink operation, in a closed system finely comminuted coal is slurried with liquid parting medium which contains a selected sulfanilate salt ionic surfactant dissolved therein. When the mass of solid particles have become thoroughly wetted, the liquid-solids slurry admixture is allowed to stand until the main body of the liquid medium has substantially clarified. Ultrasonic vibration can be employed to accelerate the settling of pyrite and ash solids.

Purified coal is recovered as a coal float phase, and pyrite/ash is recovered as a sink phase. The density of the liquid parting medium is intermediate between the coal particles and the pyrite/ash particles.

The relative weight proportion of coal to liquid parting medium is not critical, and is dictated by practical considerations. The quantity of liquid parting medium can vary from about 1 to 100 in weight ratio to the comminuted coal being treated. A weight ratio between about 1.5 and 10 to 1 of liquid medium to coal is suitable for typical processing systems.

A closed processing system is employed in order to prevent volatilization of the organic liquid medium. A halogenated hydrocarbon liquid medium is a relatively expensive commodity. Also, the presence of gaseous halogenated hydrocarbons in the atmosphere can constitute a serious pollution hazard.

Since the present invention coal desulfurization process relies on physical interaction for selective separation of pyrite and ash impurities, i.e., gravity concentration, it is simple and convenient to operate the liquid-solids system over a broad range of temperature and pressure conditions.

In a preferred embodiment, the coal desulfurization process is operated on a continuous basis. This is readily accomplished by a conventional arrangement of liquid reservoir, and endless belt conveyors for introduction of untreated pulverized coal into the liquid parting medium and for removal of the coal float phase and the pyrite/ash sink phase. One type of integrated liquid reservoir and solids conveyor equipment is described in U.S. Pat. No. 3,252,769.

For the practice of the present invention process on a continuous basis, pulverized coal is delivered to one end of the liquid reservoir on an endless belt conveyor. The delivery end of the belt is submerged in the liquid parting medium so that the coal solids are properly wetted by the liquid. The main body of coal solids floats and spreads on the liquid surface, and is urged toward the opposite end of the reservoir as it is displaced by the continuous convey of incoming raw coal.

A second conveyor belt at the opposite end of the reseroir continuously removes the coal float phase from the liquid surface and delivers it to the next processing zone of the operation. The pyrite and ash solids which settle to the bottom of the reservoir are continuously or intermittently removed by a partially submerged conveyor system.

The purified coal solids which are recovered from the float phase are heavily wetted with parting medium liquid and ionic surfactant. Separation of the adsorbed liquid from the coal can be accomplished by delivering the wetted coal solids onto a fine mesh screen, where filtering action removes a major quantity of retained liquid from the coal solids. The coal is then washed with a solvent, such as methanol, to complete the removal of heavy organic liquid and the ionic surfactant dissolved therein.

In a preferred embodiment, the removal of heavy organic liquid is accomplished by washing the coal solids with water, or by treating the coal solids with steam at atmospheric or elevated pressure. The water and heavy organic liquid are immiscible, so that the organic liquid is readily recoverable for recycle in the continuous process. The ionic surfactant substantially remains dissolved in the organic liquid.

It is another advantage of the present invention process that the heavy organic liquid parting medium is an excellent solvent for organic compounds contained in high sulfur types of coal. Hence, during the sink-float phase of the invention process, the liquid parting medium leaches resins and sulfur-containing organic compounds from the pulverized coal being treated. For this reason it is advantageous to provide a means in the process for separation of solvent from solute content to prevent impurity buildup in the liquid parting medium.

As previously described hereinabove, the raw coal feed can be pulverized dry or in a liquid medium. Another convenient and economical method of coal preparation is to crush and pulverize the coal in an aqueous medium. Pulverized raw coal which has an adsorbed water content of not more than about 2 weight percent can be desulfurized advantageously in accordance with the present invention process. The presence of adsorbed water in the coal solids tends to reduce the amount of heavy organic liquid which is subsequently adsorbed.

The purified coal obtained as a product of the present invention process has a substantially reduced content of inorganic and organic impurities. It is suitable for burning as fuel, or for other applications such as the production of high purity coke for electrode manufacture.

The following examples are further illustrative of the present invention. The reactants and other specific ingredients are presented as being typical, and various modifications can be derived in view of the foregoing disclosure within the scope of the invention.

EXAMPLE I

Into a 2000 milliliter flask equipped with a thermometer, stirrer, gas inlet tube and condenser was added 140 grams (0.51 mole) of triethylammonium sulfanilate (prepared from triethylamine and sulfanilic acid) and 1000 grams (0.51 mole) of polybutenyl-succinic anhydride (diluted with 29% unreacted polybutene), the polybutenyl group being obtained by reacting maleic anhydride and polybutene of 1300 molecular weight. The reaction mixture was heated under a nitrogen atmosphere at 165° C for 2 hours. Approximately 9 grams of water were removed. The yield of product, 1130 grams, was 100% of theoretical based on the following structure:

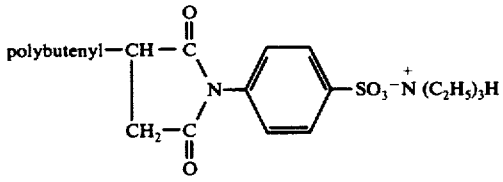

In the same manner, 0.51 mole of a bis-trimethylammonium salt of 1-amino-2,5-benzenedisulfonic acid was reacted with 0.51 mole of polybutenyl-succinic anhydride, and a 1182 gram yield of hydrocarbyl-succinimide derivative of disulfonic acid salt was obtained.

EXAMPLE II

Employing the same equipment and procedure as in Example I, the triethylammonium sulfanilate was reacted on an equimolar basis with polyalkenyl-succinic anhydride derived from the following olefins: (a) polybutene of 640 molecular weight, (b) normal octadecene, (c) iso-octadecene, and (d) polybutene of 1400 molecular weight. The reaction mixtures were heated at 165° C under nitrogen for two hours in each case.

EXAMPLE III

Into a 2000 milliliter flask equipped with a thermometer, stirrer, gas inlet tube and condenser was added 96.7 grams (0.51 mole) of ammonium sulfanilate and 1000 grams (0.51 mole) of the polybutenyl-succinic anhydride (containing 29% unreacted polybutene) of Example I. The reaction mixture was heated under nitrogen at 235° C for 45 minutes, with removal of 9 grams of water. The yield of remaining product, 1087 grams, was about 100% of theoretical.

EXAMPLE IV

Employing the same equipment and procedure as in Example I, 0.51 mole of trimethylammonium sulfanilate was reacted with 0.51 mole of the same polybutenyl-succinic anhydride at 165° C, except that the reaction was conducted for four hours under nitrogen. The product yield f 1090 grams was about 100% of theoretical.

EXAMPLE V

Finely comminuted Medium Volatile bituminous coal was desulfurized in accordance with the present invention sink-float separation process in comparison with prior art methods. The bituminous coat had a pyritic sulfur content of 2.93% (total sulfur, 3.88%), and an ash content of 13.8%.

The heavy organic liquid parting medium consisted of bromotrichloromethane, with and without a quantity of an ionic surfactant dissolved therein, respectively, as inicated hereinbelow.

In each case, 20 grams of bituminous coal was thoroughly slurried with 200 grams of organic liquid parting medium. The admixture was allowed to stand until the main body of the liquid medium had substantially clarified by formation of a coal float phase and a pyrite/ash sink phase. The coal float phase was recovered, and the sulfur and ash content of the purified coal was determined.

A reduction of sulfur content to less than 1.0 weight percent can be realized by increasing the sulfanilate salt concentration until the desired sulfur level has been achieved.

| Weight Percent Ionic Surfactant | Weight Percent Sulfur | Weight Percent Ash |
|---|---|---|
| — | 2.19 | 10.8 |
| 0.1% TRS-1080[1] | 2.17 | 10.3 |
| 0.5% TRS-1080[1] | 2.08 | 10.3 |
| 0.02% Sulfanilate salt[2] | 1.96 | 9.3 |
| 0.25% Sulfanilate salt[2] | 1.63 | 8.5 |
| 0.5% Sulfanilate salt[2] | 1.22 | 7.7 |

(1) petroleoum sulfonate sodium salt (Witco Company).
(2)

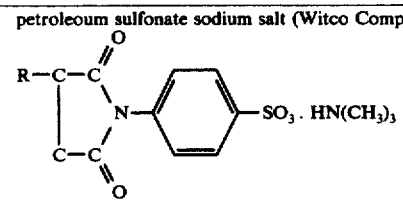

where R is polybutenyl (M.W. of 640).

What is claimed is:

1. In a process for reducing the pyritic sulfur and ash content of coal under sink-float separation conditions, the improvement which comprises (1) contacting finely comminuted coal with a heavy organic liquid medium having a specific gravity of at least 1.1, and having dissolved therein a dispersant quantity of ionic surfactant which is a hydrocarbyl-succinimide derivative of an aminoarylsulfonic acid salt; and (2) separating the coal float phase from the heavy organic liquid medium, and recovering coal with a reduced sulfur and ash content.

2. A process in accordance with claim 1 wherein the finely comminuted coal has an average particle size in the range of about 10–200 mesh.

3. A process in accordance with claim 1 wherein the heavy organic liquid is a halogenated hydrocarbon.

4. A process in accordance with claim 1 wherein the quantity of ionic surfactant dissolved in the heavy organic liquid medium is in the range between about 0.01 and 5 weight percent, based on the weight of liquid medium.

5. A process in accordance with claim 1 wherein the ionic surfactant is a salt containing the following structural elements:

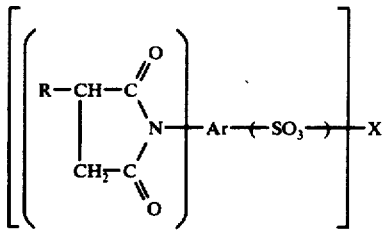

wherein R is an acyclic hyrocarbyl group containing between about 5 and 1000 carbon atoms; Ar is a polyvalent aromatic radical; X is a metal or $HNR'_3$ cation; and R' is hyrogen or a hydrocarbyl substituent.

6. A process in accordance with claim 5 wherein the hydrocarbyl-succinimido group of the ion surfactant is at least partially in a hydrolyzed form as an acyclic amido/carboxylate structure.

* * * * *